United States Patent [19]

Gordon et al.

[11] 3,958,417

[45] May 25, 1976

[54] SUPPRESSION OF UNSTABLE BURNING IN ROCKET MOTORS

[75] Inventors: Stuart Gordon, Cleobury Mortimer; Geoffrey Ian Evans, Bewdley; Philip Graham Jones, Kidderminster; Stephen William Bell, Thaydon Bois, all of England

[73] Assignee: Imperial Metal Industries (Kynoch) Limited, England

[22] Filed: Nov. 14, 1967

[21] Appl. No.: 683,764

[30] Foreign Application Priority Data

Nov. 16, 1966 United Kingdom..... 51411/66

[52] U.S. Cl...... 60/219; 60/255; 102/103; 149/11; 264/3 R

[51] Int. Cl.[2]..... F23R 1/18

[58] Field of Search.....60/219; 149/2, 7, 19; 86/1

[56] References Cited

UNITED STATES PATENTS

| | | | |
|---|---|---|---|
| 3,053,709 | 9/1962 | Herty | 149/19 |
| 3,054,253 | 9/1962 | Chung | 86/1 X |
| 3,190,776 | 6/1965 | Ender | 149/19 X |
| 3,260,631 | 7/1966 | Witz et al. | 149/7 |

*Primary Examiner*—Leland A. Sebastian
*Attorney, Agent, or Firm*—Cushman, Darby & Cushman

[57] ABSTRACT

A method of suppressing unstable burning in a solid propellant rocket motor comprising combusting a silicone elastomer with burning of the solid propellant to produce a continuous stream of small silica particles which suppress instability.

6 Claims, 2 Drawing Figures

INVENTORS
STUART GORDON
GEOFFREY IAN EVANS
PHILIP GRAHAM JONES
STEPHEN WILLIAM BELL
BY
Cushman, Darby & Cushman
ATTORNEYS

SUPPRESSION OF UNSTABLE BURNING IN ROCKET MOTORS

BACKGROUND OF THE INVENTION

1. Field of the Invention

The present invention relates to solid propellants for rocket motors and to rocket motors containing the propellants. The invention is equally applicable to cartridge loaded propellants which are fitted in rather than bonded to a rocket motor casing, and to case-bonded propellants, which are bonded directly to the motor casing or more usually to an insulation lining inside the motor casing.

2. Description of Prior Art

Hitherto, solid propellant rocket motors have frequently exhibited the phenomenon of unstable burning which can produce pressure fluctuations in the motor combustion chamber of an amplitude sufficient to rupture the motor casing. The pressure fluctuations have also produced undesirable variations in the thrust resulting from disturbances in the burning mode of the propellant. Thus the motor performance is then extremely unpredictable.

Resonance rods and baffles have been used in rocket motors for the suppression of unstable burning. However, the use of these in rocket motors comprises optimum design of the motor by the addition of inert weight to the motor.

It is also known to include metal particles, usually aluminium particles which have a size of the order of 10 microns, in the propellant grain for the suppression of unstable burning, but this has the disadvantage of producing excessive smoke in the motor exhaust. In addition, the burning rate is affected by the aluminium, and radio frequency signals transmitted to the motor guidance and control systems through the motor exhaust are attenuated and modulated.

SUMMARY OF THE INVENTION

In accordance with the present invention, a method of suppressing unstable burning in a solid propellant rocket motor comprises combusting a silicone elastomer with burning of the solid propellant.

The combustion of the elastomer produces a continuous uniform stream of small silica particles, of the order of one micron in size, in the exhaust gases of the motor. Suppression of instability is produced by these silica particles without the inert weight of rods or baffles and without the smoke and signal attenuation of aluminium powder.

Preferably the silicone elastomer is bonded to the solid propellant, and because the silicone rubber can also be used to inhibit the combustion of the surfaces of the propellant to which it is bonded, preferably also the silicone elastomer is bonded to solid propellant surfaces of which combustion inhibition is required.

The silicone elastomer can be used for solid propellant grains and for case-bonded solid propellant rocket motors, so that, in accordance with the invention also, a method of manufacturing a solid propellant grain intended for use in a solid propellant rocket motor comprises providing the propellant with a silicone elastomer in such a way that at least some of the silicone elastomer will be combusted with burning of the solid propellant grain, and a method of manufacturing a case-bonded solid propellant rocket motor comprises providing a casing for the motor with solid propellant and with a silicone elastomer in such a way that at least some of the silicone elastomer will be combusted with burning of the solid propellant.

The invention is equally effective with solid propellant grains of the cast double-base or extruded double-base type, i.e. a nitric ester nitrocellulose base propellant, and propellant grains of the composite type consisting of a resin fuel and an oxidiser material.

For a propellant grain intended for use in a cartridge loaded motor, the elastomer is bonded to the surface of the propellant grain. For a case-bonded motor, the elastomer is bonded as an intermediate layer between the propellant grain and the motor casing. Alternatively, for either a cartridge loaded or case-bonded motor, the elastomer may be located and bonded to the propellant grain at or near the head end of the rocket motor or propellant grain, or bonded along the length of any longitudinal perforations or conduits in the grain.

A further alternative is that the elastomer is included in and uniformly distributed throughout the propellant grain. Thus if the propellant is a cast double-base propellant, the granules of the propellant can be provided with an internal dispersion of particles of the silicone elastomer, or with a discontinuous surface coating of the silicone elastomer. It is generally preferred, however, that the elastomer is bonded to the propellant grain surface.

In cases where the elastomer must be bonded to the propellant grain surface by means of a bonding agent, any suitable known agent, such as a silicone adhesive or a polyvinyl acetal may be used.

The silicone elastomer may be unfilled, usually when combustion stabilising only is required, but when combustion inhibition is also required, the elastomer may incorporate fillers, such as silica in finely divided form, salts and oxides of metals, asbestos, ferrous materials, antimony sulphide, magnesia and glass. The fillers serve to enhance the erosion resistance, flame resistance, hardness or tensile strength according to which filler or combination of fillers is chosen.

It is often advantageous to firstly form the propellant grain by casting, moulding or extrusion processes and to subsequently apply the elastomer by spray or dip coating. Such techniques are both economic and avoid the necessity of specialised equipment. These techniques also permit easy formation of shapes and forms in locations not readily achievable by conventional preformed techniques.

Before application of the elastomer, the grain is firstly painted or otherwise covered with a primer suitable for use with the particular silicone elastomer which is to be applied. The primer conveniently contains a silicone resin. It is essential, when the propellant formulation contains lead salts, that the primer is applied in a medium which has essentially no solvent power on the lead salts. Unless this is so the lead salts will be extracted from the propellant grain and deposited upon its surface as a fine crystalline or powder deposit which may adversely affect the bonding between the elastomer and the grain. The lead salt exposed in this way normally interferes with the cross-linking and curing actions and prevents the formation in situ of an adequately cured rubber. Toluene is a suitable solvent which avoids this problem.

When the primer has been applied to the propellant grain, a premixed fluid silicone compound and curing agent mixture is applied in the requisite thickness to the propellant grain and allowed to cure to a solid silicone elastomer by standing for an appropriate time. The mode of application may be spray or dip coating. The silicone elastomer used is typically "SILCOSET 105" or "SILCOSET 150" both obtainable from Nobel Division of Imperial Chemical Industries Limited with the appropriate primer and accelerator systems.

Alternatively, the silicone elastomer may be bonded to a preformed propellant grain in the form of sheet or film. The elastomer applied in this manner may be cured or uncured. In the latter case, curing is effected after bonding to the grain. Any suitable adhesive may be used for bonding the elastomer to the propellant grain, e.g. a silicone adhesive or a polyvinyl acetal.

In a further method of producing a solid propellant grain having a layer of silicone elastomer on its surface, the silicone elastomer may firstly be formed into a shell having the required configuration and then the propellant grain cast or moulded inside the preformed elastomer shell. The surfaces of the elastomer mating with the propellant grain may be pretreated with a bonding agent to provide a sound bond.

The amount of silicone elastomer applied to the surface of the propellant grain is determined by whether it is intended solely for the suppression of unstable burning or additionally for the inhibition of combustion. If only suppression of unstable combustion is required, it is necessary to provide sufficient elastomer to ensure that it is uniformly combusted during combustion of the propellant to form a uniform continuous stream of silica particles in the exhaust gases of the motor. When inhibition of combustion is additionally required, it is necessary to provide an amount of elastomer in excess of the amount which will be combusted and consumed for suppressing unstable burning. It has been found that a portion of silicone elastomer equivalent to about 1% by weight of the propellant grain is in most cases satisfactory for providing suppression of unstable burning and inhibition of combustion, although up to 5% can be provided for fully suppressing unstable combustion, and up to about 20% can be provided for full combustion inhibition effects.

The invention also consists in a solid propellant grain intended for use in a solid propellant rocket motor provided with a silicone elastomer for at least partial burning during combustion of the propellant, the silicone elastomer constituting approximately 1% to 20% of the weight of the propellant grain.

The invention further consists in a case-bonded solid rocket motor provided with solid propellant and a silicone elastomer for at least partial burning during combustion of the propellant, the silicone elastomer constituting approximately 1% to 20% of the combined weights of silicone elastomer and propellant.

Observations of solid propellants according to the invention have shown that the silicone elastomers used burn without the production of black carbonaceous smoke and maintain their mechanical properties over extremely wide temperature ranges. In consequence, the elastomers do not limit the exposure to or usage at temperature extremes of the propellants and they do not stress the propellant grain. In contrast to cellulosic inhibiting materials, such as cellulose acetate, the silicone elastomers do not appreciably absorb nitroglycerine from the propellant grain over prolonged periods at elevated temperatures, the absorption being only 0.1–0.2% so that there is no danger of the silicone elastomers used as combustion inhibitors becoming highly combustible as occurs with cellulosic materials. Silicone rubber is approximately 100 times more permeable to nitrogen than a doublebase propellant throughout the normal temperature range at which rocket motors are stored, and hence the risk of permanent decomposition gases, particularly nitrogen, produced during degradation of the propellant grain resulting in early cracking of the propellant or leading to separation from the propellant at the inhibitor on account of build-up of pressure within the propellant or at the propellant inhibitor interface is less than that with hitherto available inhibitors.

BRIEF DESCRIPTION OF THE DRAWINGS

The invention will now be exemplified with reference to the accompanying drawings, in which.

DESCRIPTION OF THE PREFERRED EMBODIMENT

Figure 1:
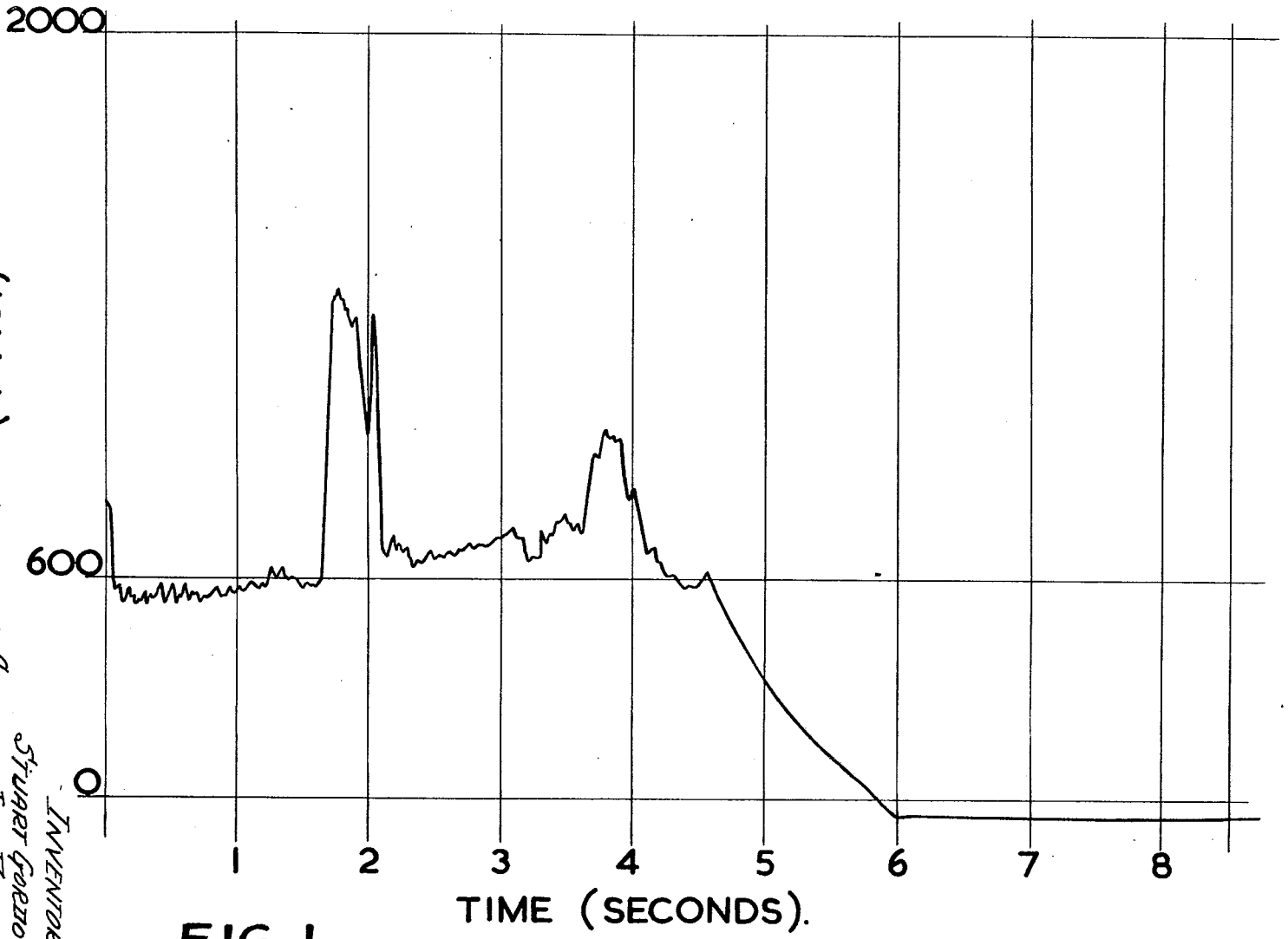
FIG. 1 is a firing record for a rocket motor having a conventional combustion inhibitor applied to the propellant grain, with no suppressants for unstable burning.

The firing record shown in FIG. 1 relates to a rocket motor having a single propellant grain 6 inches in diameter of the four-slotted perforated internally burning type. The propellant grain was inhibited externally with cellulose acetate and contained no additives for combatting unstable burning. The firing record shows the extreme fluctuations in pressure at the nozzle end of the motor which occurred during combustion of the grain.

Figure 2:
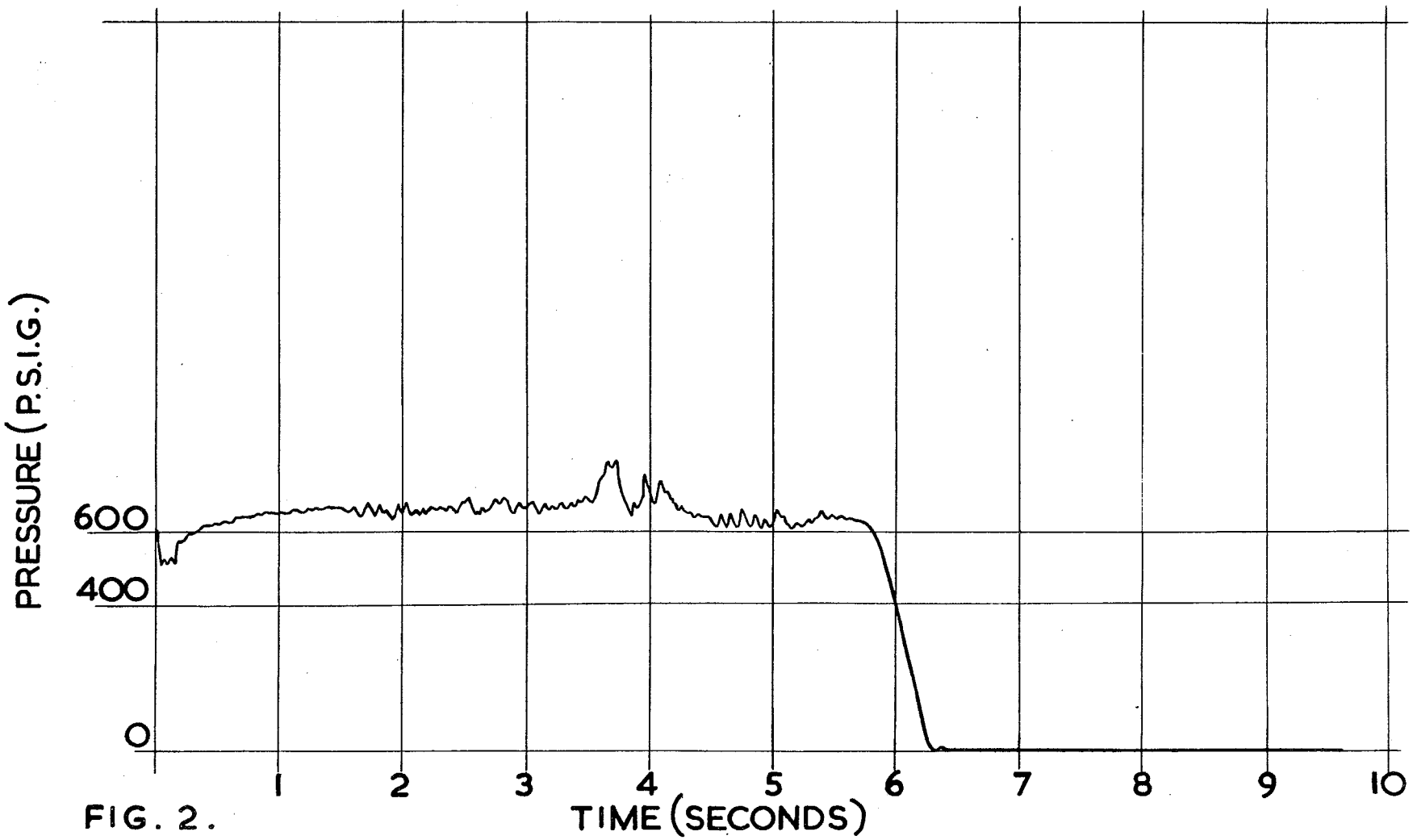
FIG. 2 is a firing record for a rocket motor having a silicone elastomer inhibitor applied to the propellant grain.

FIG. 2 shows a firing record for a rocket motor having a solid propellant similar to that to which FIG. 1 relates. A siloxane elastomer was applied as a thin layer (about 0.020 inch thick) to the forward end face of the propellant, the elastomer used was "SILCOSET 105". The firing record demonstrates that the extreme fluctuations in pressure record at the nozzle end of the rocket under combustion which are represented in FIG. 1 were eliminated. It was also noted that the exhaust gases produced were free of black carbonaceous smoke and that the siloxane functioned efficiently as a combustion inhibitor.

We claim:

1. A solid propellant rocket motor comprising:
   - a casing;
   - a nitric ester nitrocellulose cast double base propellant within the casing; and
   - a layer of combustion-inhibition material bonded to the surfaces of the propellant of which combustion inhibition is required, said combustion-inhibition material being a self-supporting silicone elastomer, at least part of said layer of combustion-inhibition material being exposed for at least partial burning during combustion of the propellant, said elastomer being present in an amount in excess of the amount combusted during combustion of the propellant.

2. A rocket motor according to claim 1 wherein the silicone elastomer constitutes approximately 1% to 20% of the combined weights of silicone elastomer and propellant.

3. A rocket motor according to claim 1 wherein at least part of said layer of silicone elastomer is interposed between and bonded to the casing and the propellant to case-bond the propellant in the casing of the rocket motor.

4. A method of suppressing unstable burning and inhibiting combustion in a solid propellant rocket motor having a casing and a nitric ester nitrocellulose cast double base propellant within the casing, said method comprising:

bonding a layer of a self-supporting silicone elastomer to those surfaces of the propellant of which combustion inhibition is required at a location such that at least part of the layer is exposed for at least partial burning during combustion of the propellant, said elastomer being provided in an amount in excess of the amount which will be combusted during operation of the motor; and subsequently combusting the elastomer with the burning of the propellant during operation of the motor.

5. A method as in claim 4 wherein the silicone elastomer constitutes approximately 1% to 20% of the combined weights of the elastomer and the propellant.

6. A method as in claim 4 wherein at least part of said layer of silicone elastomer is interposed between and bonded to the casing and to the propellant to case-bond the propellant in the casing of the rocket motor.

* * * * *